US010047738B2

(12) United States Patent
Van Dam et al.

(10) Patent No.: US 10,047,738 B2
(45) Date of Patent: Aug. 14, 2018

(54) DOWNHOLE RADIALLY ACTUATED LONGITUDINAL DIAPHRAGM PUMP

(71) Applicant: General Electric Company, Schenectady, NY (US)

(72) Inventors: Jeremy Daniel Van Dam, West Coxsackie, NY (US); Ameen Roshdy Aboel Hassan Muhammed, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 124 days.

(21) Appl. No.: 14/089,154

(22) Filed: Nov. 25, 2013

(65) Prior Publication Data

US 2015/0147209 A1 May 28, 2015

(51) Int. Cl.

| | |
|---|---|
| ***F04B 43/08*** | (2006.01) |
| ***F04B 43/02*** | (2006.01) |
| *F04B 47/02* | (2006.01) |

(52) U.S. Cl.

CPC ..... *F04B 43/084* (2013.01); *F04B 43/02* (2013.01); *F04B 47/02* (2013.01)

(58) Field of Classification Search

CPC ..... F04B 43/02; F04B 43/025; F04B 43/026; F04B 45/04; F04B 45/043; F04B 43/08; F04B 43/084; F04B 45/06; F04B 45/10; F04B 47/02

USPC ..... 417/395, 413.1, 44.9

See application file for complete search history.

(56) References Cited

U.S. PATENT DOCUMENTS

| | | | | |
|---|---|---|---|---|
| 1,714,440 A | | 5/1929 | Harry | |
| 2,392,117 A | * | 1/1946 | Burks | 417/521 |
| 2,483,218 A | * | 9/1949 | Meath | 417/521 |
| 2,808,005 A | * | 10/1957 | Fannin | 417/285 |
| 2,871,795 A | * | 2/1959 | Smith | 417/534 |

(Continued)

FOREIGN PATENT DOCUMENTS

EP 2048361 A1 4/2009

OTHER PUBLICATIONS

EngineeringToolbox.com . website. May 8, 2006. <http://web.archive.org/web/20060508165125/http://www.engineeringtoolbox.com/torsion-shafts-d_947.html . >.*

(Continued)

*Primary Examiner* — Bryan Lettman

(74) *Attorney, Agent, or Firm* — GE Global Patent Operation; Pabitra Chakrabarti

(57) ABSTRACT

A diaphragm pump and pump system including a pump housing defined along a longitudinal axis and having one or more pumping chambers and one or more driving chambers. At least two check valves communicating with each of the one or more pumping chambers for conducting a production fluid into and out of the pumping chamber. One or more flexible axially elongated diaphragms are mounted in the pump housing and sealingly separate the one or more pumping and driving chambers. At least one cam mechanism is disposed in the pump housing and coaxially therewith the pump housing longitudinal axis. The cam mechanism is configured for rotational movement to provide for radial deflection of the one or more flexible axially elongated diaphragms into the one or more pumping chambers to affect pumping of a production fluid therethrough the diaphragm pump.

16 Claims, 5 Drawing Sheets

(56) References Cited

U.S. PATENT DOCUMENTS 2,970,748 A * 2/1961 Bendall ..... F04B 45/10 417/475
3,050,013 A * 8/1962 Ketterer ..... 417/536
3,229,643 A * 1/1966 Roudaut ..... 417/475
3,251,305 A * 5/1966 Schlosser ..... 92/82
3,542,491 A * 11/1970 Newman ..... F04B 43/0072 417/214
3,849,026 A * 11/1974 Hartley ..... 417/203
3,953,154 A 4/1976 Wanner
4,389,163 A 6/1983 Magnussen et al.
4,509,410 A * 4/1985 Blin ..... F04B 43/021 417/413.1
4,569,643 A * 2/1986 Draper ..... 417/536
5,279,504 A 1/1994 Williams
5,286,176 A * 2/1994 Bonin ..... F04B 43/123 417/322
6,017,198 A 1/2000 Traylor et al.
6,824,139 B2 * 11/2004 Barinaga ..... B41J 2/17596 277/628
7,040,869 B2 * 5/2006 Beenker ..... F04B 43/02 417/413.2
8,235,955 B2 8/2012 Blott et al.
8,454,325 B2 6/2013 Fisher et al.
8,469,681 B2 6/2013 Wheal
2003/0194332 A1 * 10/2003 Jahn ..... F04B 43/0733 417/395
2007/0110597 A1 * 5/2007 Traylor et al. ..... 417/394
2008/0292477 A1 * 11/2008 Stimpson ..... F04B 43/02 417/413.1
2011/0081265 A1 * 4/2011 Williams ..... F04B 17/03 417/413.1
2013/0004344 A1 * 1/2013 McKinney et al. ..... 417/366

OTHER PUBLICATIONS

International Search Report and Written Opinion issued in connection with corresponding PCT Application No. PCT/US2014/066070 dated Feb. 18, 2015.

* cited by examiner

DOWNHOLE RADIALLY ACTUATED LONGITUDINAL DIAPHRAGM PUMP

BACKGROUND

The present disclosure relates to downhole pumps. More particularly, the present disclosure relates to downhole diaphragm pumps configured to provide improved performance over a range of flow rates encountered in unconventional wells with a resulting increase in production rates and total reservoir recovery.

Pump systems are used in a wide variety of environments, including wellbore applications for the growing market of unconventional wells. Unconventional wells, such as unconventional gas reservoirs, including coal bed methane and ultralow-permeability sand/shale, present unique challenges. Among these challenges are corrosive environments, high temperatures, large temperature differentials, high pressures and significant pressure differentials, mixed phase production of water, oil, gas and solid particulate, corrosive chemicals, unsteady flow rates, and significant declines in total production rate over time. Currently suboptimal artificial lift (AL) methods are used to produce these wells resulting in loss of production and a reduction in total recovery of the reservoirs.

Unconventional wells require special recovery operations outside the conventional operating practices. It is known to use displacement pumps for high pressure applications. In particular, diaphragm pumps provide sealing of the pressure generating elements from the production fluid by one or more diaphragms. In this type of pump, the production fluid is caused to move into and out of one or more pump sub-chambers through one or more check valves to accomplish the pumping action. There are many examples of this type pump in the patent literature, but in general they are not utilized in downhole unconventional pumping situations due to high cost and unreliability.

In the field of oil and gas, there is a strong business need for reliable efficient and flexible artificial lift devices that can operate in the harsh conditions of unconventional wells. Accordingly, it is desired to provide for a diaphragm pump for use in downhole unconventional well applications that is configured for operation in corrosive environments including high temperature environments with large temperature differentials and high pressure environments, with significant pressure differentials. In addition, it is desirable to provide for a diaphragm pump for use in the mixed phase production of water, oil, gas and solid particulate, and for use with corrosive chemicals and unsteady flow rates, without a significant decline in total production rate over time. Further, it is desired to provide for a diaphragm pump that includes tolerance to contaminants, such as sand, thus providing for an increase in the lifespan of the pump.

BRIEF DESCRIPTION

These and other shortcomings of the prior art are addressed by the present disclosure, which provides a downhole radially actuated longitudinal diaphragm pump and pump system.

One aspect of the present disclosure resides in a diaphragm pump including a pump housing, at least two check valves, one or more flexible axially elongated diaphragms and at least one cam mechanism. The pump housing having defined along a longitudinal axis and having therein one or more pumping chambers and one or more driving chambers. The at least two check valves communicating with each of the one or more pumping chambers for conducting a production fluid into and out of the pumping chamber The one or more flexible axially elongated diaphragms are mounted in the pump housing and sealingly separate the one or more pumping chambers and the one or more driving chambers. The at least one cam mechanism, comprising a cam plate and a cam shaft, disposed in the pump housing and coaxially therewith the pump housing longitudinal axis. The at least one cam mechanism configured for rotational movement, wherein the rotational movement of the cam plate provides for radial deflection of the one or more flexible axially elongated diaphragm into the one or more pumping chambers to affect pumping of a production fluid therethrough the diaphragm pump.

Another aspect of the present disclosure resides in a diaphragm pump system, including a diaphragm pump and a rotatable driver configured to operate the diaphragm pump. The diaphragm pump including a pump housing, one or more flexible axially elongated diaphragms and at least one radially actuated cam mechanism. The pump housing defined along a longitudinal axis and having defined therein one or more pumping chambers and one or more driving chambers, the pump housing. The one or more flexible axially elongated diaphragms mounted in the pump housing and sealingly separating the one or more pumping chambers and the one or more driving chambers. The at least one radially actuated cam mechanism disposed in the pump housing and coaxial therewith the pump housing longitudinal axis. The at least one radially actuated cam mechanism configured for rotational movement, wherein the rotational movement provides for radial deflection of the one or more flexible axially elongated diaphragms into the one or more pumping chambers to affect pumping of a production fluid therethrough the diaphragm pump system.

Yet another aspect of the disclosure resides in a diaphragm pump including a pump housing, at least two check valves, a first flexible axially elongated diaphragm, a second flexible axially elongated diaphragm and at least one cam mechanism. The pump housing having defined along a longitudinal axis and having therein one or more pumping chambers and one or more driving chambers. The at least two check valves communicating with each of the one or more pumping chambers for conducting a production fluid into and out of the pumping chamber The first flexible axially elongated diaphragm mounted in the pump housing and sealingly separating the one or more pumping chambers and the one or more driving chambers. The second flexible axially elongated diaphragm mounted in the pump housing and sealingly separating the one or more pumping chambers and the one or more driving chambers. The at least one cam mechanism, comprising a cam plate and a cam shaft, disposed in the pump housing and coaxially therewith the pump housing longitudinal axis. The at least one cam mechanism configured for rotational movement, wherein the rotational movement of the cam plate provides for radial deflection of the first flexible axially elongated diaphragm and the second flexible axially elongated diaphragm into the one or more pumping chambers to affect pumping of a production fluid therethrough the diaphragm pump.

Various refinements of the features noted above exist in relation to the various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
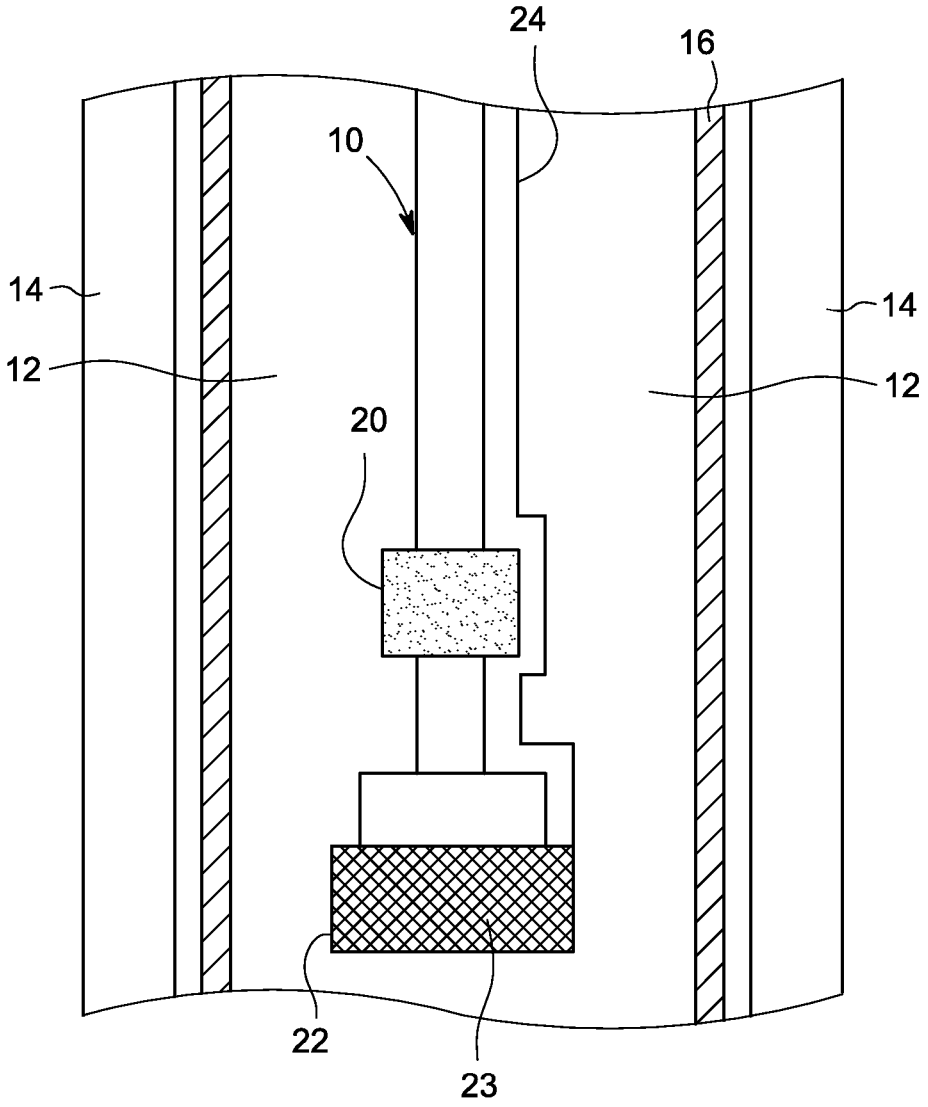
FIG. 1 is a schematic side view of an downhole pump assembly disposed within a wellbore in accordance with one or more embodiments shown or described herein.

The disclosure will be described for the purposes of illustration only in connection with certain embodiments; however, it is to be understood that other objects and advantages of the present disclosure will be made apparent by the following description of the drawings according to the disclosure. While preferred embodiments are disclosed, they are not intended to be limiting. Rather, the general principles set forth herein are considered to be merely illustrative of the scope of the present disclosure and it is to be further understood that numerous changes may be made without straying from the scope of the present disclosure.

As described in detail below, embodiments of the present disclosure provide a diaphragm pump system and a diaphragm pump for use in unconventional downhole well applications. Using such disclosed configurations, the diaphragm pump and pump system may provide improved recovery of unconventional reservoirs.

The terms "first," "second," and the like, herein do not denote any order, quantity, or importance, but rather are used to distinguish one element from another and intended for the purpose of orienting the reader as to specific components parts. Approximating language, as used herein throughout the specification and claims, may be applied to modify any quantitative representation that could permissibly vary without resulting in a change in the basic function to which it is related. The modifier "about" used in connection with a quantity is inclusive of the stated value, and has the meaning dictated by context, (e.g., includes the degree of error associated with measurement of the particular quantity). Accordingly, a value modified by a term or terms, such as "about", is not limited to the precise value specified. In some instances, the approximating language may correspond to the precision of an instrument for measuring the value.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise. In addition, in this specification, the suffix "(s)" is usually intended to include both the singular and the plural of the term that it modifies, thereby including one or more of that term (e.g., "the cam mechanism" may include one or more cam mechanisms, unless otherwise specified). Reference throughout the specification to "one embodiment," "another embodiment," "an embodiment," and so forth, means that a particular element (e.g., feature, structure, and/or characteristic) described in connection with the embodiment is included in at least one embodiment described herein, and may or may not be present in other embodiments. Similarly, reference to "a particular configuration" means that a particular element (e.g., feature, structure, and/or characteristic) described in connection with the configuration is included in at least one configuration described herein, and may or may not be present in other configurations. In addition, it is to be understood that the described inventive features may be combined in any suitable manner in the various embodiments and configurations.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances, an event or capacity can be expected, while in other circumstances the event or capacity cannot occur—this distinction is captured by the terms "may" and "may be".

Referring now to the drawings, FIG. 1 illustrates an exemplary downhole pump system 10 including a radially actuated longitudinal diaphragm pump, wherein the downhole pump system 10 is disposed within a wellbore 12. In an embodiment, the wellbore 12 is formed in a geological formation 14, for example, an oilfield. The wellbore 12 is further lined by a casing 16, as indicated in FIG. 1. In some embodiments, the casing 16 may be further perforated to allow a fluid to be pumped (referred to herein as "production fluid") to flow into the casing 16 from the geological formation 14 and pumped to the surface of the wellbore 12. The downhole pump system 10 is intended for use in downhole applications in unconventional wells.

As illustrated in FIG. 1, the downhole pump system 10 includes a radially actuated longitudinal diaphragm pump 20, a rotatable driver 22, such as an electric motor 23, configured to operate the radially actuated longitudinal diaphragm pump 20, and an electric cable 24 configured to power the rotatable driver 22. It is anticipated that the radially actuated longitudinal diaphragm pump as disclosed herein is operable using any type of rotating driver, including a hydraulic turbine, a gas turbine, or the like. As noted earlier, the downhole pump system 10 according to some embodiments of the invention is disposed within a wellbore 12 of an unconventional well. Accordingly, in such embodiments, the downhole pump system 10 and the components of the downhole pump system 10 may be subjected to extreme conditions such as high temperatures, large temperature differentials, high pressures, significant pressure differentials, mixed phase production of water, oil, gas and solid particulate, unsteady flow rates, exposure to contaminants, such as sand or corrosive chemicals and significant declines in total production rate over time.

Figure 2:
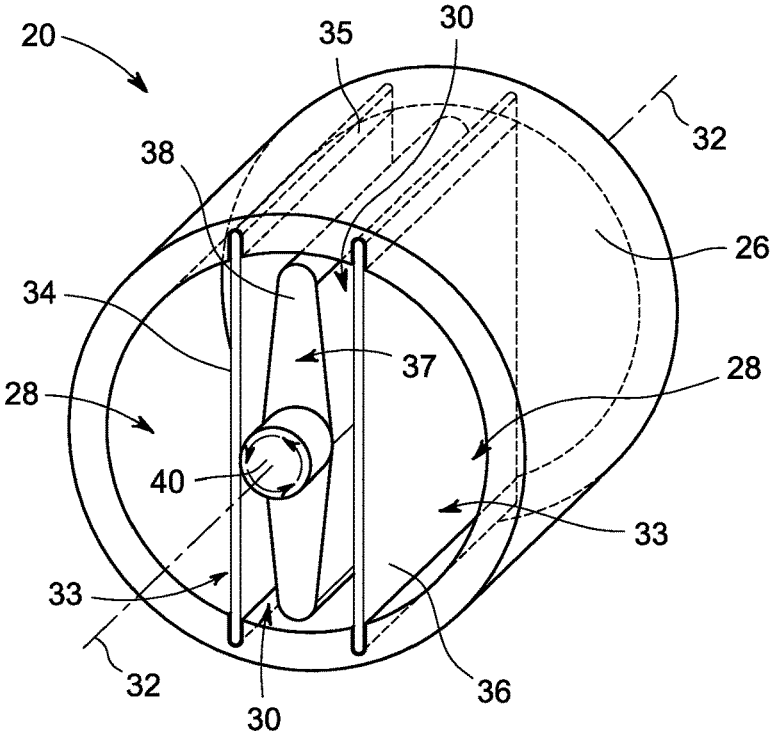
FIG. 2 is a schematic orthogonal view of a portion of a radially actuated longitudinal diaphragm pump in accordance with one or more embodiments shown or described herein.
Figure 3:
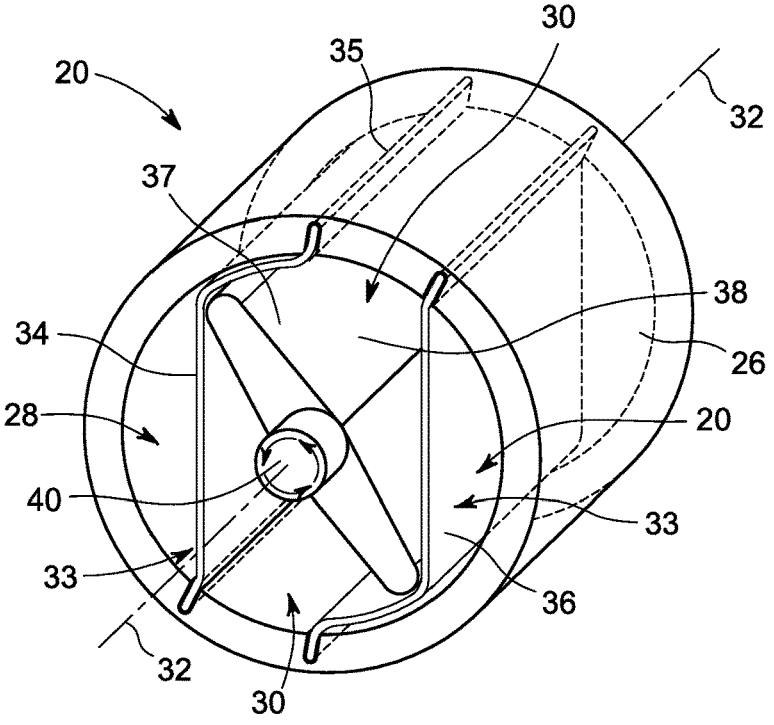
FIG. 3 is a schematic orthogonal view of a portion of the radially actuated longitudinal diaphragm pump of FIG. 2, illustrating movement of the cam mechanism, in accordance with one or more embodiments shown or described herein.
Figure 4:
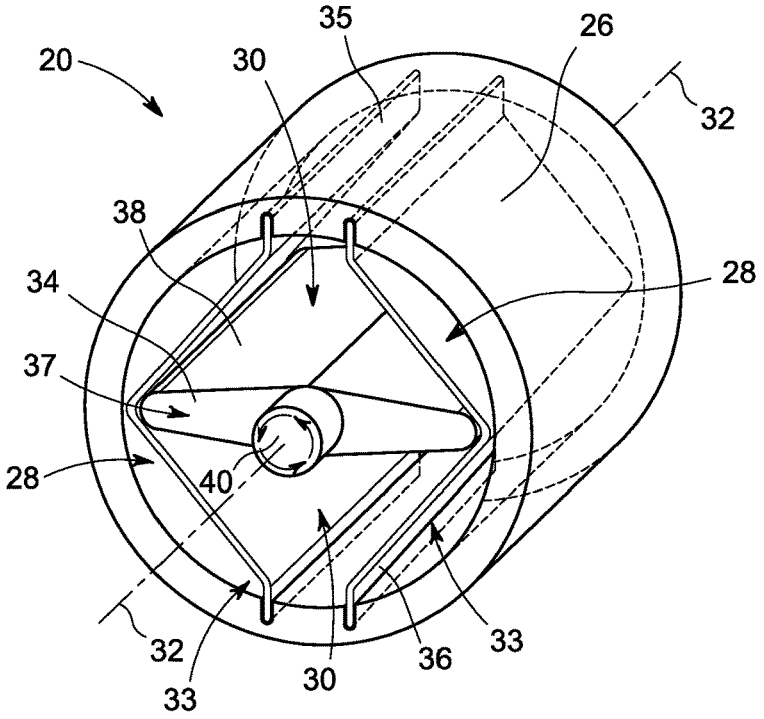
FIG. 4 is a schematic orthogonal view of a portion of the radially actuated longitudinal diaphragm pump of FIG. 2, illustrating further movement of the cam mechanism, in accordance with one or more embodiments shown or described herein.

In an embodiment, the present disclosure provides the radially actuated longitudinal diaphragm pump 20 that is capable of withstanding high temperatures, high pressures, exposure to contaminants and additional extreme conditions, such as those previously mentioned. With reference to FIGS. 2-11, the radially actuated longitudinal diaphragm pump 20 according to an embodiment includes a generally cylindrical, preferably steel, pump housing 26 configured for disposing within the wellbore 12 (FIG. 1). The pump housing 26 includes one or more internal pumping and driving chambers 28 and 30, respectively, each coaxially defined within the cylindrical pump housing 26 about an axis 32. One or more flexible axially elongated diaphragm 33 are mounted in housing 26. In an embodiment, as best illustrated in FIGS. 2-4, the radially actuated longitudinal diaphragm pump 20 includes a first flexible axially elongated diaphragm 34 and a second flexible axially elongated diaphragm 36 are mounted in housing 26. The first flexible axially elongated diaphragm 34 and the second flexible axially elongated diaphragm 36 are mounted in housing 26 via a clamping mechanism 35. It is anticipated in an alternate embodiment, that the first flexible axially elongated diaphragm 34 and the second flexible axially elongated diaphragm 36 may be mounted within the pump housing 26 using alternative means. In another alternate embodiment, the one or more flexible axially elongated diaphragm 33 may include a single flexible axially elongated diaphragm configured to divide the internal pumping and driving chambers 28 and 30, or three or more flexible axially elongated diaphragms wherein the diaphragms are configured to divide the internal pumping and driving chambers 28 and 30 into equal segments (i.e., 120°, 240°, etc). In addition, in yet another alternate embodiment, the one or more flexible axially elongated diaphragm 33 includes a continuous flexible axially elongated tubular diaphragm 39, described presently with regard to FIG. 5 that does not require a sealed joint to the pump housing 26.

In the illustrated embodiments, the one or more flexible axially elongated diaphragms 33 may be comprised of an elastomeric material, such as rubber. In an alternate embodiment, the one or more flexible axially elongated diaphragms 33 may be comprised of a materials, such as, but not limited to, titanium alloy, preferably titanium alloy 6-4 (6% aluminum, 4% vanadium and 90% titanium), polytetrafluoroethylene (PTFE) coated material, or the like. The one or more flexible axially elongated diaphragms 33 sealingly separate the pumping chambers 28 from the driving chambers 30.

Figure 10:
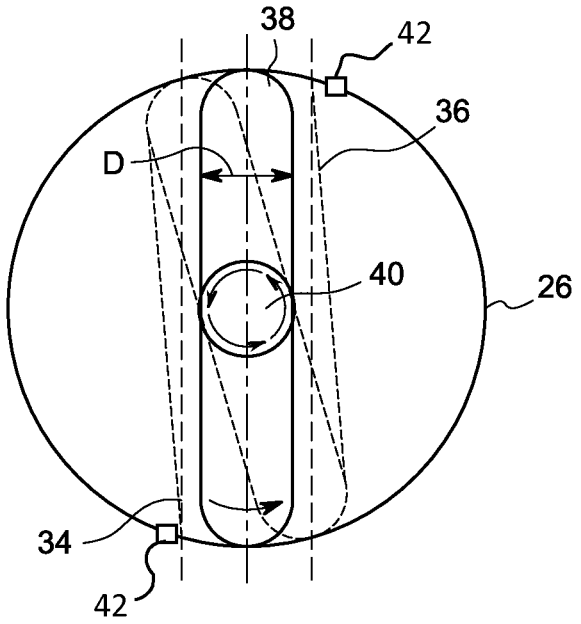
FIG. 10 is a schematic cross-section of a portion of the radially actuated longitudinal diaphragm pump of FIGS. 2-4 in accordance with one or more embodiments shown or described herein.
Figure 11:
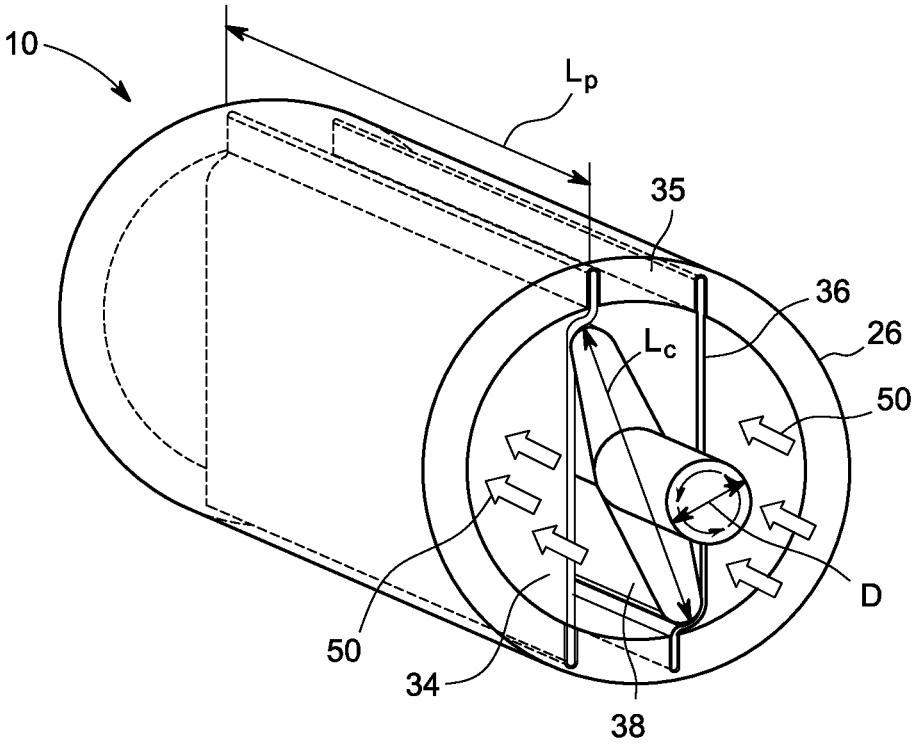
FIG. 11 is a schematic orthogonal view of a portion of a radially actuated longitudinal diaphragm pump in accordance with one or more embodiments shown or described herein.

As best illustrated in FIGS. 2-5, the radially actuated longitudinal diaphragm pump 20 further includes a cam mechanism 37, comprised of a cam plate 38 that is rigidly secured to a cam shaft 40. A diameter of the cam plate 38 is limited by the cam shaft 40 torque and lateral forces exerted upon the cam plate 38 by the one or more flexible axially elongated diaphragms 33. More specifically, in the embodiment illustrated in FIGS. 2-4, a diameter of the cam plate 38 is limited by the cam shaft 40 torque and lateral forces exerted upon the cam plate 38 by the first flexible axially elongated diaphragm 34 and the second flexible axially elongated diaphragm 36. In the embodiment illustrated in FIG. 5, a diameter of the cam plate 38 is limited by the cam shaft 40 torque and lateral forces exerted upon the cam plate 38 by the continuous flexible axially elongated tubular diaphragm 39. As best illustrated in FIGS. 10 and 11, in an embodiment, the cam plate 38 diameter "D" is calculated using the following equations:

To determine D from torque "T"

$$D = \left(\frac{16T}{\pi\tau}\right)^{\frac{1}{3}} \tag{1}$$

To determine torque from the pressure in the chamber $$A = \frac{1}{4}\pi D L_p \tag{2}$$

$$T = P_d\left(\frac{1}{4}\pi D L_p\right)0.5L_c \tag{3}$$

To calculate the diameter of the cam plate 38, substitution of Equations (1)-(3) provides the following equations $$D^3 = \frac{16}{\pi\tau} \tag{4}$$

$$D^3 = \frac{16}{\pi\tau}P_d\left(\frac{1}{4}\pi D L_p\right)0.5L_c \tag{5}$$

$$D_2 = \frac{1}{\tau}4P_d L_p L_c \tag{6}$$

Therefore, the complete equation for D will be $$D = \sqrt{\frac{0.5P_d L_p L_c}{\tau}} \tag{7}$$

Where $L_c$=cam length, $L_p$=pump length and $\tau$=allowable shear strength.

For example, in an embodiment wherein the pump housing 26 has a 3" interior diameter, and at a pressure of 2188 psi, using the previously mentioned Eq. (1), the diameter of the cam plate would be 1.4".

Referring again to FIGS. 2-5, in an embodiment, the first flexible axially elongated diaphragm 34 and the second flexible axially elongated diaphragm 36 and the continuous flexible axially elongated tubular diaphragm 39 are radially actuated in response to a rotational movement of the cam plate 38, as indicated by arrows in FIGS. 2-5. The cam plate 38 and the cam shaft 40 extend axially therethrough the center of the radially actuated longitudinal diaphragm pump 20. In an embodiment, the cam shaft 40 extends upwardly or downwardly from the radially actuated longitudinal diaphragm pump 20 and is driven by an electric motor 22 (FIG. 1).

Two or more check valves 42 are in fluid communication with each of the pumping chambers 28. In an embodiment, a first check valve 44 and a second check valve 46 are provided per chamber 28. Each of the two or more check valves 42 are coupled to the rotation of the cam shaft 40 to maximize active pumping area.

Figure 5:
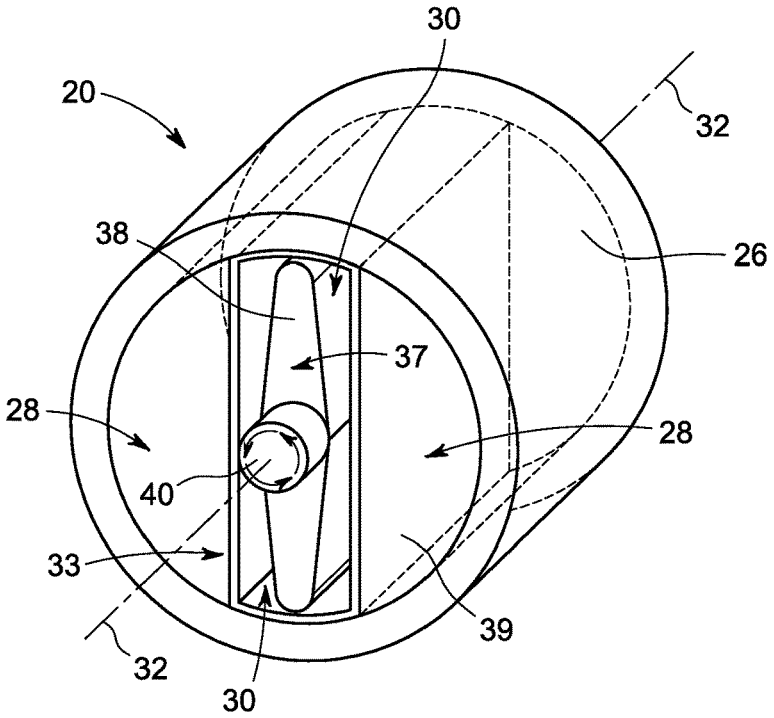
FIG. 5 is a schematic orthogonal view of a portion of an alternate embodiment of a radially actuated longitudinal diaphragm pump in accordance with one or more embodiments shown or described herein.

As previously mentioned, in an embodiment, the radially actuated longitudinally diaphragm pump may include the one or more flexible axially elongated diaphragms 33, and more particularly a single continuous flexible axially elongated tubular diaphragm 39, as best illustrated in FIG. 5, defining internal pumping chambers 28 and driving chamber 30. In this particular embodiment, the continuous flexible axially elongated tubular diaphragm 39 does not require a sealed joint to the pump housing 26. In contrast to the previously described embodiment, the continuous flexible axially elongated tubular diaphragm 39 is mechanically restrained by the metal housing 26 in a manner to prevent the cam mechanism 37 from pushing it out of the way.

Figure 6:
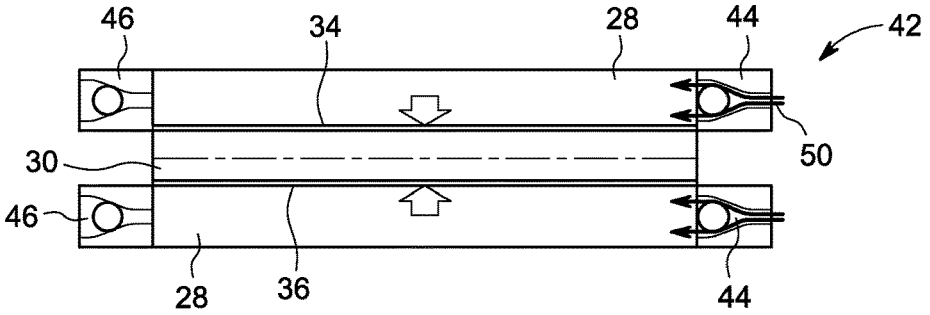
FIG. 6 is a schematic diagram of a portion of a radially actuated longitudinal diaphragm pump during operation in accordance with one or more embodiments shown or described herein.
Figure 7:
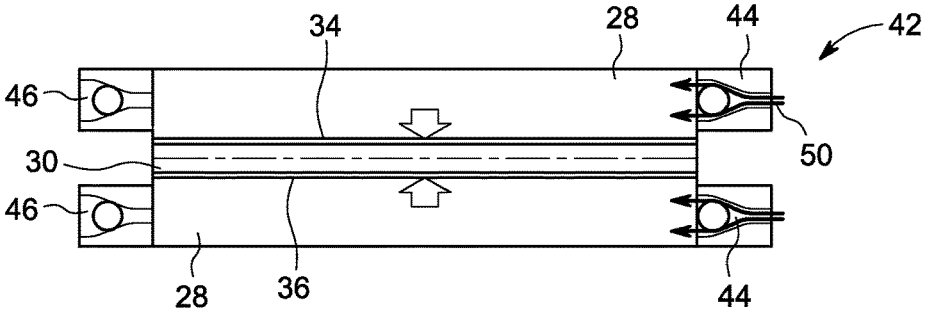
FIG. 7 is a schematic diagram of a portion of a radially actuated longitudinal diaphragm pump during operation in accordance with one or more embodiments shown or described herein.
Figure 8:
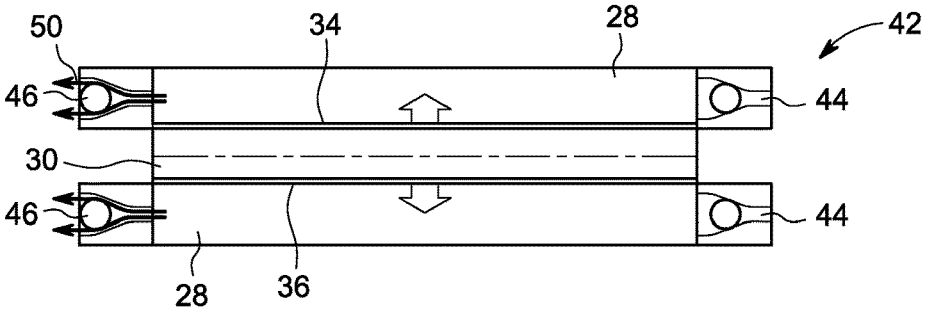
FIG. 8 is a schematic diagram of a portion of a radially actuated longitudinal diaphragm pump during operation in accordance with one or more embodiments shown or described herein.
Figure 9:
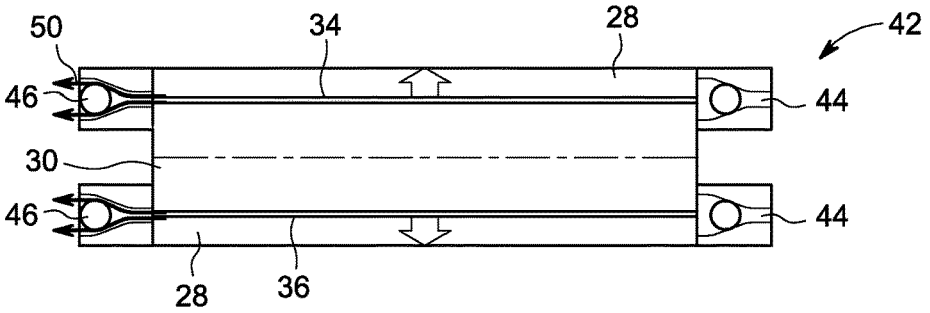
FIG. 9 is a schematic diagram of a portion of a radially actuated longitudinal diaphragm pump during operation in accordance with one or more embodiments shown or described herein.

Referring now to FIGS. 6-9, illustrated is an embodiment of the radially actuated longitudinal diaphragm pump 20 during operation including the first flexible axially elongated diaphragm 34 and the second flexible axially elongated diaphragm 36. During operation, rotational movement of the cam shaft 40 and thus the cam plate 38 (FIGS. 2-4) flexes or moves the first flexible axially elongated diaphragm 34 and the second flexible axially elongated diaphragm 36 through a simple sweeping mechanical action. When the volume of the pumping chambers 28 is increased, and more specifically when the first flexible axially elongated diaphragm 34 and the second flexible axially elongated diaphragm 36 are unflexed, the pump is operational in a suction stroke, as best illustrated in FIGS. 6 and 7, whereby the pressure decreases and the production fluid 50 is drawn into the pumping chambers 28. When the pressure in chambers 28 later increases, due to the rotational movement of the cam shaft 40 and the cam plate 38, more specifically when the first flexible axially elongated diaphragm 34 and the second flexible axially elongated diaphragm 36 are flexed in response to the rotational sweeping motion of the cam plate 28, the pump is operational in a discharge on stroke, as best illustrated in FIGS. 8 and 9, whereby the pressure increases and the production fluid 50 is forced out of the pumping chambers 28. Finally, as operation progresses, the first flexible axially elongated diaphragm 34 and the second flexible axially elongated diaphragm 36 are positioned once again in an unflexed position, drawing the production fluid 50 into the chambers 28 and completing the cycle.

During operation, each of the one or more check valves 42 are configured to open and close to fill a respective pumping chamber 28 in the suction stroke (FIGS. 6 and 7) and expel a production fluid 50 from the radially actuated longitudinal diaphragm pump 20 in the discharge stroke (FIGS. 8 and 9). It should be understood that embodiments including fewer or greater flexible axially elongated diaphragms 33 or a single continuous flexible axially elongated tubular diaphragm 39 (FIG. 5) would operate in a generally similar manner.

Referring now to FIG. 10, in an embodiment, the radially actuated longitudinal diaphragm pump 20 is seen to have a generally circular cross-sectional shape. In an embodiment the check valves 42 are disposed at approximately a 0°-30° angle to the unflexed first flexible axially elongated diaphragm 34 (shown in dashed line) and the unflexed second flexible axially elongated diaphragm 36 (shown in dashed line). As will be apparent from a consideration of FIG. 10 in light of FIG. 1, the pump housing portion 26 includes a generally circular interior surface 27 disposed coaxially with cam shaft 40 about axis 32.

The operation of radially actuated longitudinal diaphragm pump 20 is described with respect to an artificial lift requiring the pumping of the production fluid 50 (FIG. 11) at a high instantaneous rate, for example in the range of from 5-15 gallons per minute (GPM), and high peak pressure, for example, in the range of 5,000-15,000 pounds per square inch (psi). In such an application, the production fluid 50 is conducted into pumping chambers 28 via the one or more check valves 42 at a constant pressure of approximately 500 to 700 psi.

In one exemplary construction of an embodiment, the first flexible axially elongated diaphragm 34 and the second flexible axially elongated diaphragm 36 are selected to have a diameter of sufficient length to allow for disposing and clamping within the housing 26, and a thickness in the range of 15-17 mils. In an embodiment, the one or more check valves 42 would in an ideal situation be disposed substantially parallel to the plane (as best illustrated in FIGS. 6 and 7) of the unflexed first flexible axially elongated diaphragm 34 and the unflexed second flexible axially elongated diaphragm 36, practical construction limitations dictate that the angle between the one or more check valves 42 and the first flexible axially elongated diaphragm 34 and the second flexible axially elongated diaphragm 36 be not less than about 10°. It has been determined that angles up to 30° would provide for proper operation of the radially actuated longitudinal diaphragm pump 20. It will, of course, be appreciated by those skilled in the art that these dimensions can be varied to meet different operational requirements.

To pump the production fluid 50 outward of the pump housing 26 via the one or more check valves 42 and the pumping chambers 28, the cam plate 38 is caused to rotate in a radial movement about axis 32. Further in accordance with the present disclosure, this rotational movement of the cam plate 38 serves to provide a rapid sweeping pressure across the surface of the one or more flexible axially elongated diaphragms 33. This sweeping motion serves to increase the lifespan of the one or more flexible axially elongated diaphragms 33 by inhibiting wear or puncture at any single, high-pressure point. The rotational sweeping motion of the cam plate 38 thus causes the one or more flexible axially elongated diaphragms 33 to deflect into pumping chambers 28, thereby forcing the production fluid 50 in each of the pumping chambers 28 out through the one or more check valves 42. With the continued rotational motion of the cam plate 38, each of the one or more flexible axially elongated diaphragms 33 is caused to deflect into their respective pumping chamber 28.

In an embodiment, optional sealable vent apertures (not shown) may operate to vent air trapped in the pumping chambers 28 during an initial cycle of the pump operation. These vent apertures are sealed after the initial pump cycle, for example with a threaded plug (not shown), and remain sealed during continued operation of the pump. If the operation of the radially actuated longitudinal diaphragm pump 20 is discontinued in a manner permitting air to enter the pumping chamber 28, the appropriate vent aperture is unsealed to vent the air during the subsequent initial pump cycle.

In summary, a new and improved diaphragm pump and pump system are disclosed for use in downhole unconventional well applications. The diaphragm pump and pump system are configured for operation in corrosive environments, including those having high temperatures, large temperature differentials, high pressures and significant pressure differentials, mixed phase production of water, oil, gas and solid particulate, corrosive chemicals, unsteady flow rates, and significant declines in total production rate over time.

Further, provided is a diaphragm pump and pump systems that are tolerant to contaminants, such as sand, thus providing for an increase in the lifespan of the pump. The resulting diaphragm pump and pump system are capable of pumping operation in unconventional wells at high rates and pressures while maintaining reliable operation over a long, effective lifespan.

While only certain features of the disclosure have been illustrated and described herein, many modifications and changes will occur to those skilled in the art. It is, therefore, to be understood that the appended claims are intended to cover all such modifications and changes as fall within the true spirit of the disclosure. This written description uses examples to disclose the disclosure, including the best mode, and also to enable any person skilled in the art to practice the disclosure, including making and using any devices or systems and performing any incorporated methods. The representative examples and embodiments provided herein include features that may be combined with one another and with the features of other disclosed embodiments or examples to form additional embodiments that are still within the scope of the present disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A diaphragm pump comprising:

a cylindrical pump housing having defined therein a plurality of chambers consisting of two pumping chambers and two driving chambers, the cylindrical pump housing defined along a longitudinal axis;

at least two check valves communicating with each of the two pumping chambers for conducting a mixed phase production fluid into and out of the two pumping chambers as an axial flow;

one or more flexible axially elongated diaphragms mounted in the cylindrical pump housing and sealingly separating the two pumping chambers and the two driving chambers, each of the one or more flexible axially elongated diaphragms having a length extending along a complete length of the cylindrical pump housing in a direction parallel to the longitudinal axis, wherein each of the one or more flexible axially elongated diaphragms is flexible from one side of the elongated diaphragm to another side in a direction perpendicular to the longitudinal axis of the cylindrical pump housing and wherein the at least two check valves are disposed with a flow direction parallel to an axial plane of each of the one or more flexible axially elongated diaphragms when in an unflexed position; and at least one cam mechanism, comprising a cam plate and a cam shaft, each of the cam plate and the cam shaft disposed in the cylindrical pump housing and extending coaxially therewith the cylindrical pump housing longitudinal axis and along the complete length of the cylindrical pump housing, the at least one cam mechanism configured for rotational movement, wherein the rotational movement of the cam plate provides a sweeping pressure across a surface of the one or more flexible axially elongated diaphragms and along the length of the one or more flexible axially elongated diaphragms thereby providing radial deflection of the one or more flexible axially elongated diaphragms into the two pumping chambers to affect pumping of the mixed phase production fluid therethrough during a suction stroke, whereby the a mixed phase production fluid is drawn into the two pumping chambers simultaneously, and during a discharge stroke, whereby the mixed phase production fluid is forced out of the two pumping chambers simultaneously.

2. The diaphragm pump of claim 1, wherein the one or more flexible axially elongated diaphragms include a first flexible axially elongated diaphragm and a second flexible axially elongated diaphragm.

3. The diaphragm pump of claim 1, wherein the one or more flexible axially elongated diaphragms include a single continuous flexible axially elongated tubular diaphragm.

4. The diaphragm pump of claim 1, wherein each of the two pumping chambers defines an internal volume within the cylindrical pump housing, the internal volume configured to receive the mixed phase production fluid.

5. The diaphragm pump of claim 1, wherein the diaphragm pump is configured as a downhole pump.

6. The diaphragm pump of claim 1, wherein the one or more flexible axially elongated diaphragms are coupled to the cylindrical pump housing by a clamping mechanism.

7. The diaphragm pump of claim 1, wherein the one or more flexible axially elongated diaphragms are at least partially flat when in the unflexed position.

8. The diaphragm pump of claim 1, wherein the one or more flexible axially elongated diaphragms extend radially across the cylindrical pump housing.

9. The diaphragm pump of claim 1, wherein a diameter "D" of the cam plate is determined by the equation:

$$D = \left(\frac{16T}{\pi\tau}\right)^{\frac{1}{3}}$$

Where: $T = P_d(A)0.5L_c$ $$A = \frac{1}{4}\pi D L_p$$

T=a torque A=a pumping area $L_c$=a cam length $L_p$=a pump length $P_d$=a chamber pressure $\tau$=an allowable shear strength.

10. A diaphragm pump system, comprising:

a diaphragm pump; and a rotatable driver configured to operate the diaphragm pump, wherein the diaphragm pump comprises:

a cylindrical pump housing having defined therein a plurality of chambers consisting of two pumping chambers and two driving chambers, the cylindrical pump housing defined along a longitudinal axis;

at least two check valves each communicating with a respective one of the two pumping chambers for conducting the mixed phase production fluid into and out of the two pumping chambers as an axial flow;

one or more flexible axially elongated diaphragms mounted in the cylindrical pump housing and sealingly separating the two pumping chambers and the two driving chambers, each of the one or more flexible axially elongated diaphragms having a length extending along a complete length of the cylindrical pump housing in a direction parallel to the longitudinal axis, wherein each of the one or more flexible axially elongated diaphragms is flexible from one side of the elongated diaphragm to another side in a direction perpendicular to the longitudinal axis of the cylindrical pump housing and wherein the at least two check valves are disposed with a flow direction parallel to an axial plane of each of the one or more flexible axially elongated diaphragms when in an unflexed position; and at least one radially actuated cam mechanism, comprising a cam plate and a cam shaft, each of the cam plate and the cam shaft disposed in the cylindrical pump housing and extending coaxial therewith the cylindrical pump housing longitudinal axis and along the complete length of the cylindrical pump housing, the at least one radially actuated cam mechanism configured for rotational movement, wherein the rotational movement provides a sweeping pressure across a surface of the one or more flexible axially elongated diaphragms and along the length of the one or more flexible axially elongated diaphragms thereby providing radial deflection of the one or more flexible axially elongated diaphragms into the two pumping chambers to affect pumping of a mixed phase production fluid therethrough during a suction stroke, whereby the mixed phase production fluid is drawn into the two pumping chambers simultaneously, and during a discharge stroke, whereby the mixed phase production fluid is forced out of the two pumping chambers simultaneously.

11. The diaphragm pump system of claim 10, including a first flexible axially elongated diaphragm and a second flexible axially elongated diaphragm.

12. The diaphragm pump system of claim 10, including a single continuous flexible axially elongated tubular diaphragm.

13. The diaphragm pump system of claim 10, wherein said cylindrical pump housing is cylindrical in geometry and wherein each of the two pumping chambers defines an internal volume within the cylindrical pump housing, the internal volume configured to receive the mixed phase production fluid.

14. The diaphragm pump system of claim 10, wherein the diaphragm pump system is configured as a downhole pump system.

15. The diaphragm pump system of claim 10, wherein the one or more flexible axially elongated diaphragms are at least partially flat when in an unflexed position and extend radially across the cylindrical pump housing.

16. A diaphragm pump comprising:

a cylindrical pump housing having defined therein a plurality of chambers consisting of two pumping chambers and two driving chambers, the cylindrical pump housing defined along a longitudinal axis;

at least two check valves communicating with each of the two pumping chambers for conducting a mixed phase production fluid into and out of the two pumping chambers as an axial flow;

a first flexible axially elongated diaphragm mounted in the cylindrical pump housing and sealingly separating the two pumping chambers and the two driving chambers;

a second flexible axially elongated diaphragm mounted in the cylindrical pump housing and sealingly separating the two pumping chambers and the two driving chambers, each of the first and second flexible axially elongated diaphragms having a length extending along a complete length of the cylindrical pump housing in a direction parallel to the longitudinal axis, wherein each of the first and second flexible axially elongated diaphragms is flexible from one side of the elongated diaphragm to another side in a direction perpendicular to the longitudinal axis of the cylindrical pump housing and wherein the at least two check valves are disposed with a flow direction parallel to an axial plane of each of the one or more flexible axially elongated diaphragms when in an unflexed position; and at least one cam mechanism, comprising a cam plate and a cam shaft, each of the cam plate and the cam shaft disposed in the cylindrical pump housing and extending coaxially therewith the cylindrical pump housing longitudinal axis and along the complete length of the cylindrical pump housing, the at least one cam mechanism configured for rotational movement, wherein the rotational movement of the cam plate provides a sweeping pressure across a surface of the first flexible axially elongated diaphragm and the second flexible axially elongated diaphragm and along the length of the first and second flexible axially elongated diaphragms thereby providing radial deflection of the first flexible axially elongated diaphragm and the second flexible axially elongated diaphragm into the two pumping chambers to affect pumping of a mixed phase production fluid therethrough during a suction stroke, whereby the mixed phase production fluid is drawn into the two pumping chambers simultaneously, and during a discharge stroke, whereby the mixed phase production fluid is forced out of the two pumping chambers simultaneously.

* * * * *